United States Patent [19]

Usami

[11] Patent Number: 4,702,590

[45] Date of Patent: Oct. 27, 1987

[54] IMAGE DENSITY CONTROL APPARATUS

[75] Inventor: Akihiro Usami, Yokohama, Japan

[73] Assignee: Canon Kabushiki Kaisha, Tokyo, Japan

[21] Appl. No.: 818,252

[22] Filed: Jan. 13, 1986

Related U.S. Application Data

[63] Continuation of Ser. No. 511,917, Jul. 8, 1983.

[30] Foreign Application Priority Data

Jul. 15, 1982 [JP] Japan ..... 122020

[51] Int. Cl.[4] ..... G03G 15/00

[52] U.S. Cl. ..... 355/14 C; 355/14 E; 355/14 R

[58] Field of Search ..... 355/14 E, 14 R, 14 D, 355/3 DD, 57, 8, 3 R, 3 CH, 68; 118/688, 691, 679, 665

[56] References Cited

U.S. PATENT DOCUMENTS

| | | | |
|---|---|---|---|
| 3,926,518 | 12/1975 | Berry et al. | 355/8 |
| 4,046,467 | 9/1977 | Laskowski et al. | 355/57 X |
| 4,200,391 | 4/1980 | Sakamoto et al. | 355/14 E |
| 4,239,374 | 12/1980 | Tatsumi et al. | 355/14 E |
| 4,352,553 | 10/1982 | Hirahara | 355/14 E |
| 4,472,046 | 9/1984 | Kohyama | 355/1 |

*Primary Examiner*—A. C. Prescott

*Attorney, Agent, or Firm*—Fitzpatrick, Cella, Harper & Scinto

[57] ABSTRACT

An image forming apparatus has a detector for detecting an image density of an original, a processing unit for forming an image, and a control unit for controlling an image forming condition of the processing unit. The control unit non-linearly controls an output thereof in response to a change of the original density detected by the detector.

16 Claims, 15 Drawing Figures

IMAGE DENSITY CONTROL APPARATUS

This is a continuation of application Ser. No. 511,917, filed July 8, 1983.

BACKGROUND OF THE INVENTION

1. Field of the Invention

The present invention relates to the image forming apparatus such as a copying machine or facsimile device.

2. Description of the Prior Art

A prior art copying machine usually has a control unit for controlling a light quantity in an original illumination light source in accordance with a sensitivity of a photosensitive drum and manually operated means for inputting a light quantity of accordance with the image density of an original.

It is very difficult to select a proper light quantity by such semi-automatic (substantially manual) means and a certain number of expensive copy forms have to be wasted by trial copies before a copy having a proper contrast is attained.

In order to resolve the above problem, copying machines having a function for detecting the original density of photo-sensing means or a surface potentiometer on the photosensitive drum to automatically control the light quantity have been proposed, but few of them discuss a way to satisfy a user's demand for controlling the light quantity in response to the detected original density (or copy density). Most of them which do discuss such control use a linear relation between the detected original density and the light quantity. In such an auto-exposure copying machine, it is usual to control the light quantity such that more light is applied to a higher density original and less light is applied to a lower density original, that is, a lighter copy is produced for a darker original and a darker copy is produced for a lighter original. However, when the linear relation of the density and the light quantity is used, a user's demand for the darker copy and the whiter copy is not satisfied.

In certain cases, only a portion of the original is detected to determing the light quantity. This results in inaccurate detection.

When a density of an entire area of the original is detected, a long time is required to determine a proper output and start the image formation.

A copying machine which controls an iris for the exposure to maintain a constant light quantity on a photo-sensitive plane without regard to a copy magnification factor has been proposed, but it is difficult to adjust the iris while taking the original density and the magnification factor into consideration.

SUMMARY OF THE INVENTION

It is an object of the present invention to provide an image forming apparatus which can attain proper copy density and contrast for a wide range of original density.

It is another object of the present invention to provide an image forming apparatus which can exactly reproduce a copy for a dark original or a white original.

It is other object of the present invention to provide an image forming apparatus which automatically controls a density during an exposure of an original for image formation.

It is other object of the present invention to provide an image forming apparatus which can exactly reproduce a copy without regard to a local change of an original density.

It is other object of the present invention to provide an image forming apparatus which can start image formation before the completion of measurement of a density of an entire area of an original.

It is other object of the present invention to provide an image forming apparatus which can form an image of a proper density in a special processing such as magnified image formation.

It is other object of the present invention to provide an image forming apparatus which can form an image with high reliability.

The above and other objects of the present invention will be apparent from the following description of the invention.

DETAILED DESCRIPTION OF THE PREFERRED EMBODIMENTS

Figure 1:
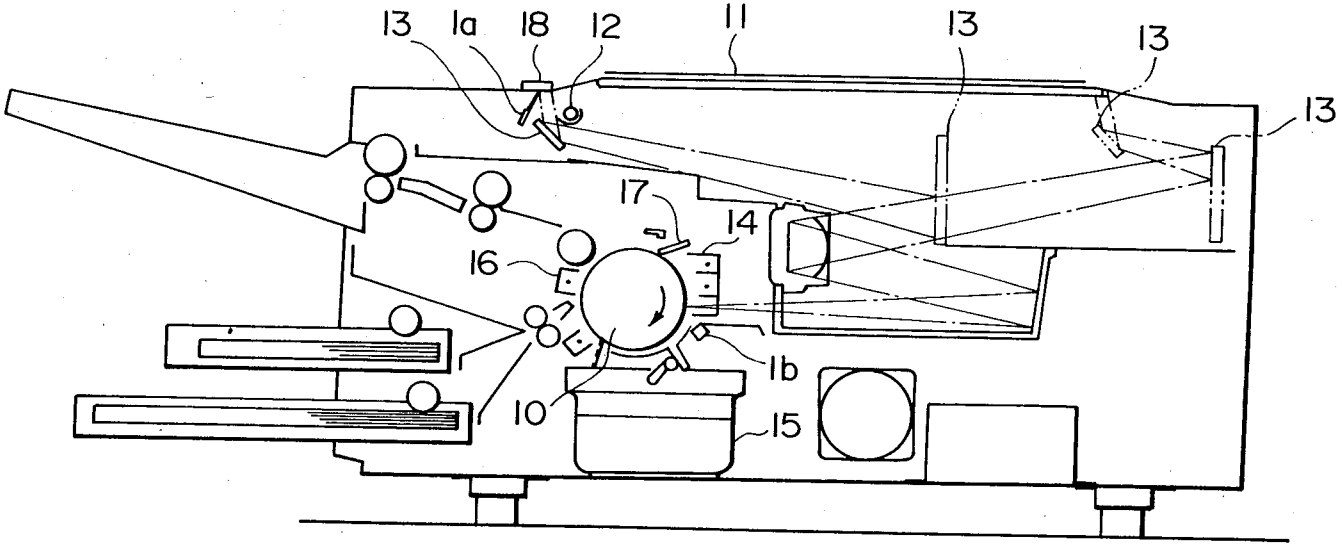
FIG. 1 is a sectional view showing a schematic construction of a copying machine in accordance with the present invention.

FIG. 1 shows a diagram of a copying machine of the present invention. A construction of the copying machine is known per se. In a copy mode, a light emitted from a light source 12 which is moved along an original 11 on an original mount 11 and reflected thereby is focused through mirrors 13 onto a photo-sensitive drum 10 which is rotated in the direction of an arrow. Through the exposure, an electrostatic latent image is formed on the drum 10 which is charged by a charger 14. The latent image is then developed by developing means 15 and the developed image is transferred to a sheet by a transfer charger 16. After the transfer, the drum 10 is cleared by a cleaner 17 for the next cycle and the charging and the exposure are effected again.

In FIG. 1, density detection means in accordance with the present invention is shown by light detection means 1*a* disposed in a vicinity of the light source 12 and surface potentiometer 1*b* disposed in a vicinity of the photo-sensitive drum 10. In the present invention, either one of those means may be used to detect the original density, or both of them may be used. The light detection means 1*a* detects a light quantity of the light reflected by the original 11 and the surface potentiometer 11*b* detects a surface potential of the photo-sensitive drum 10 after the exposure to detect the original density.

A standard white plate 18 is arranged externally of an original exposure area and it is illuminated by the lamp 12 prior to the start of image formation, and the light reflected by the standard white plate 18 is detected by the detector 1*a* or the potential by the reflected light is measured by the potentiometer 1*b* to determine if the measured value is equal to a standard value, and if it is not equal, the lamp 12 or the charger 14 is controlled to bring the measured value to the standard value. In this manner, the apparatus is set to a standard condition and the copy density after the start of the image formation is precisely controlled. This standardizing process may be effected after the turn-on of a power switch of the apparatus and before the turn-on of an image formation start switch (copy key). Thus, a rise time of the image formation can be saved.

Figure 2:
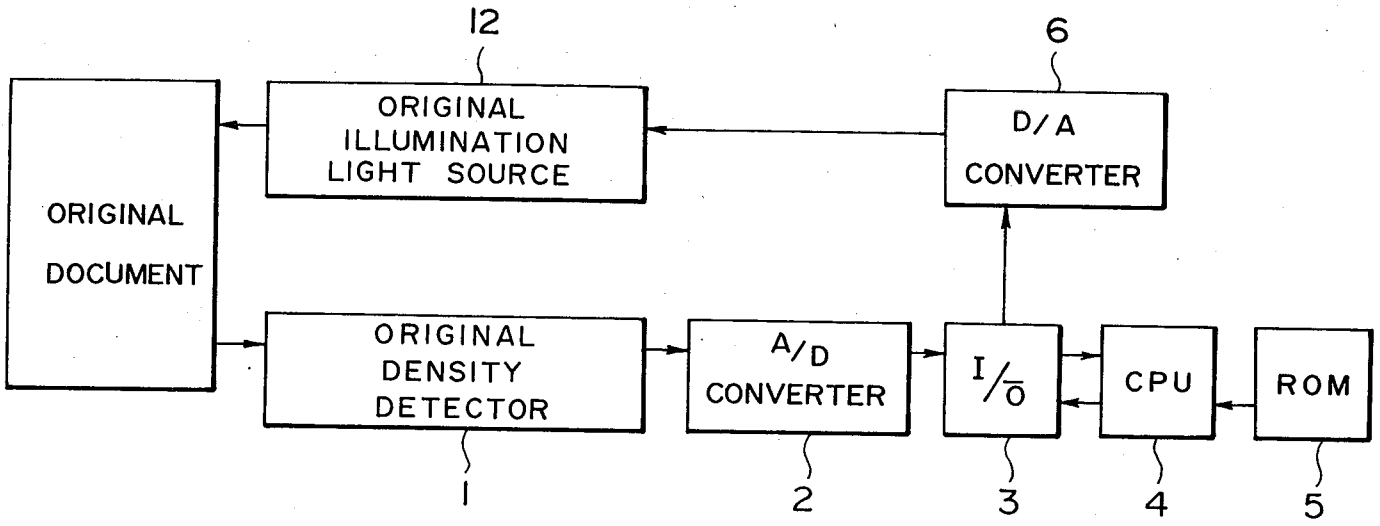
FIG. 2 shows a block diagram of a control circuit of the copying machine.
Figure 6:
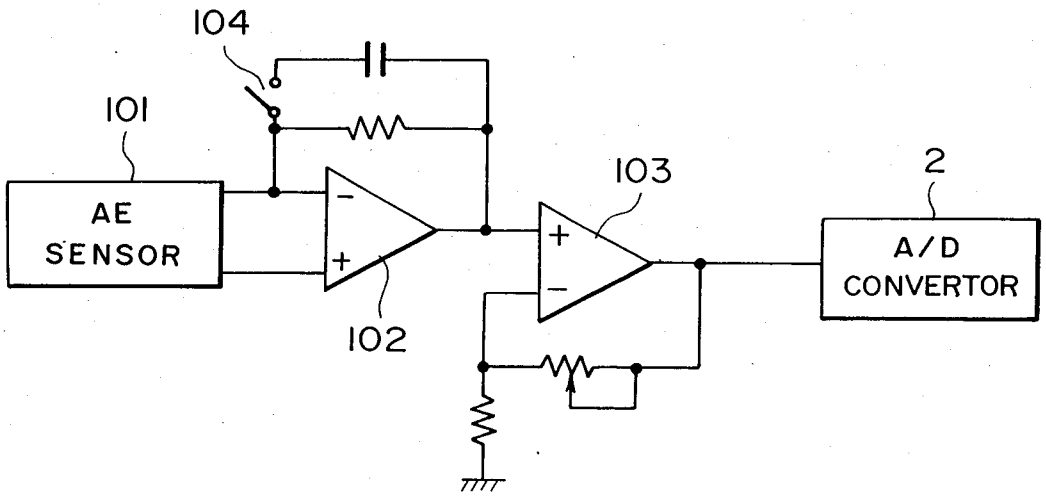
FIG. 6 shows an integration circuit having detection means shown in FIG. 1.

FIG. 2 shows a block diagram of an exposure light quantity control system of the copying machine of the present invention. An output of original density detection means 1 (1*a*, 1*b*) is digitized by an A/D converter 2 and supplied to a CPU4 through an input/output port 3. The CPU4 looks up a data table corresponding to a density-light quantity relation stored in a read-only memory (ROM) 5 by an integration of the density data to determine light quantity data, which is then supplied to the input/output port 3. FIG. 6 shows an embodiment of a circuit for integrating the detected value, numeral 101 denotes a light or potential sensor, numeral 102 denotes an operational amplifier, numeral 103 denotes a level adjusting amplifier and numeral 104 denotes an integration reset switch. An integration time is determined by a conversion time of the A/D converter 2. This is effective when the original is pre-scanned to detect an average density of the area to determine the proper output. The light quantity data is converted to an analog signal by a D/A converter 6 and supplied to the light source 12 to control the light quantity of the light source 12.

The density-light quantity data are stored in the ROM5 in a form of 8-bit information. That is, the 8-bit light quantity data are stored one for each of $256(-2^8)$ addresses. Each address corresponds to each of the detected density data. A memory address corresponding to the detected integrated density data is determined and the light quantity data at that address is read out. The ROM5 may be a writable RAM.

Examples of characteristic curves of the density-light quantity are described below.

Figure 3:
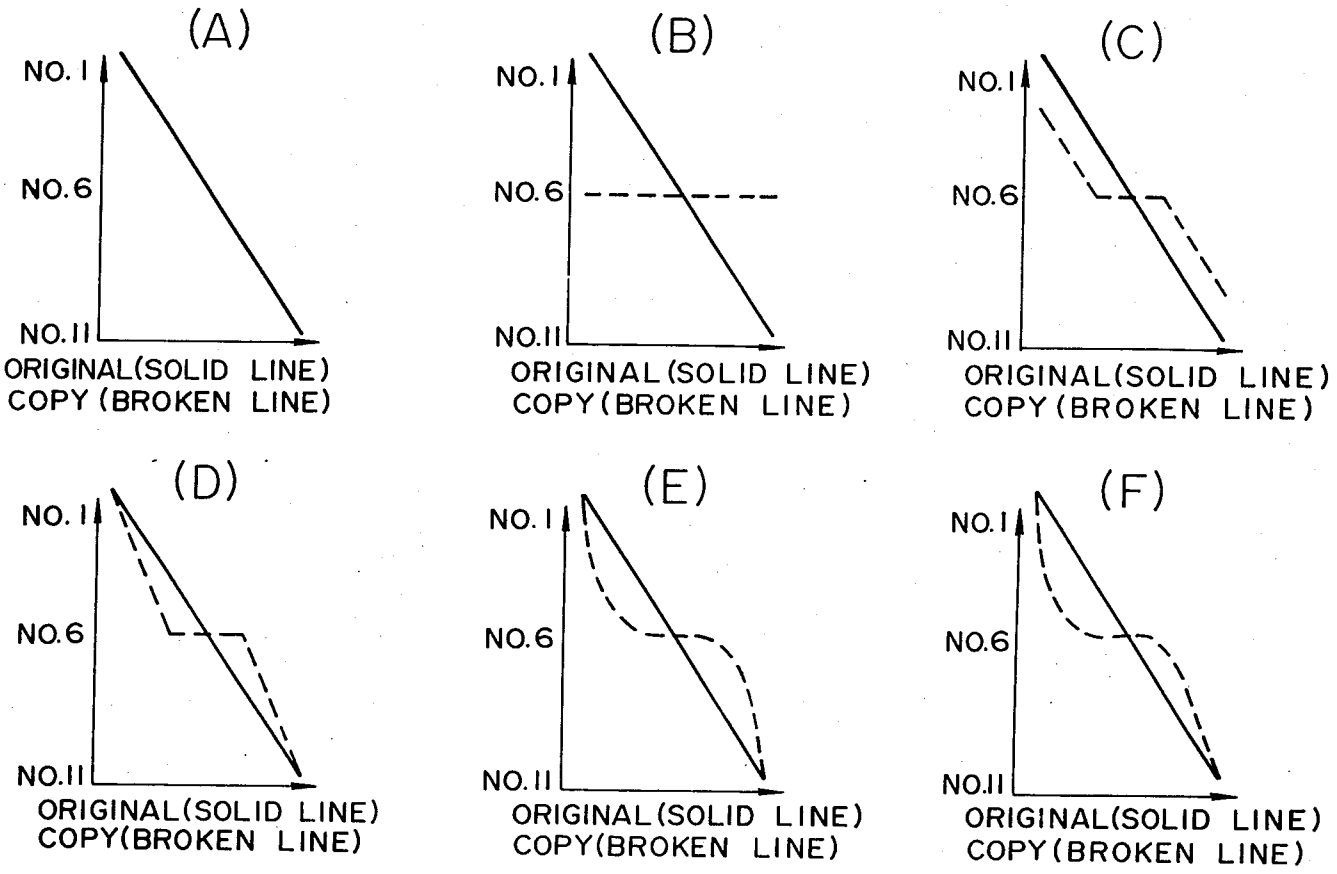
FIGS. 3(A)–3(F) are charts showing relations between an original density and a copy density.
Figure 4:
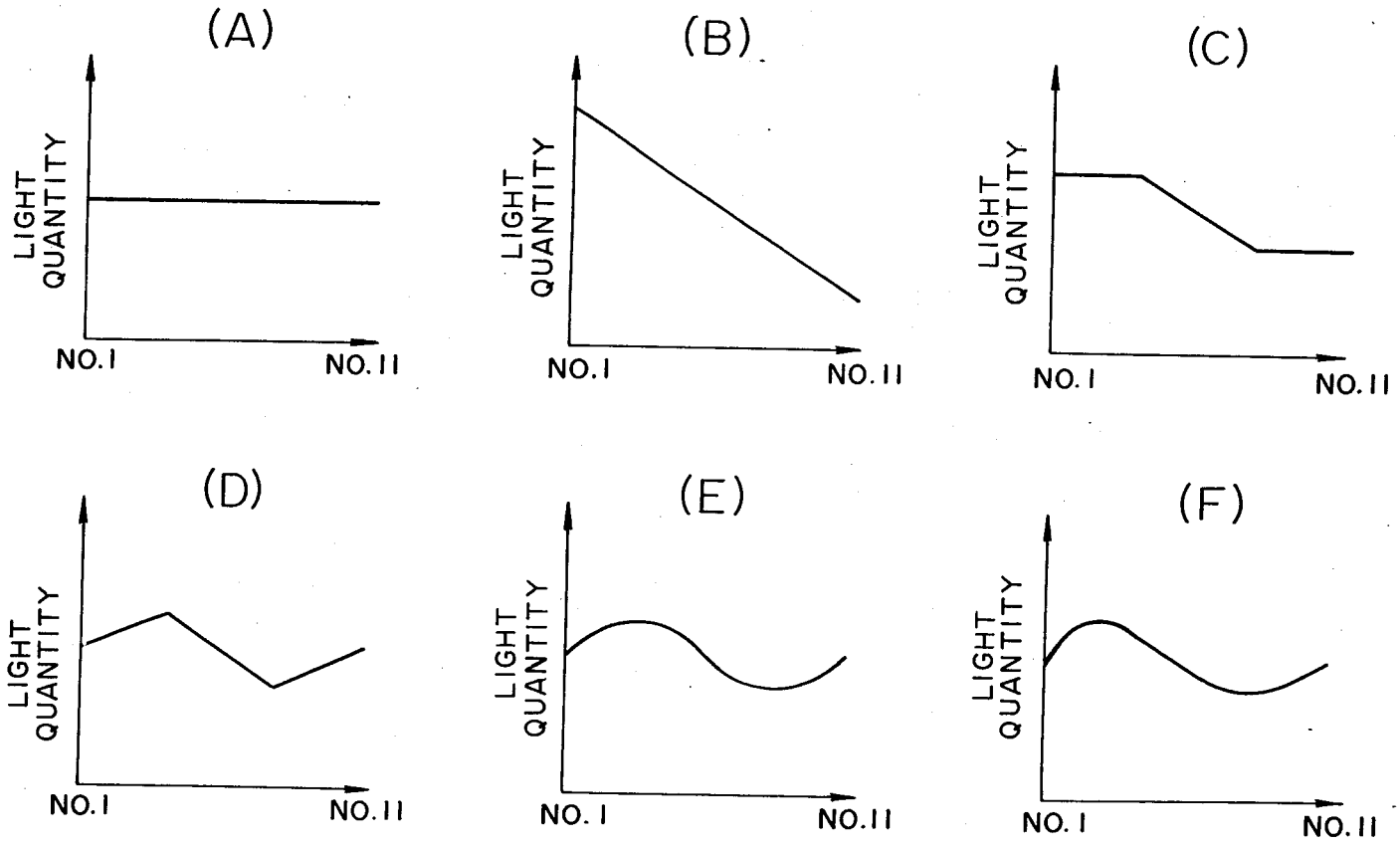
FIGS. 4(A)–4(F) are charts showing characteristics of the original density and light quantity.

Black level to white level of the original density are divided into eleven levels No. 1–No. 11 (black:No. 1 and white:No. 11) and it is assumed that the original density is distributed as shown by a solid line of FIG. 3(A). (In the prior art copying machine, when a copy is formed under a constant light quantity, the copy has the same density as that shown by the solid line. The copy density is represented by a broken line while the original density is represented by the solid line. In FIG. 3(A), the broken line and the solid line are coincident).

In a first approach, it is contemplated that the light quantity is controlled such that all of the copies of the originals having such a density distribution have the same density. A broken line in FIG. 3(B) shows the copy density. The copy densities for the density No. 1 (black) original and the density No. 11 (white) original are the same.

However, it is impractical that the white original and the black original are copied to exhibit the same copy density. Accordingly, in the present invention, the light quantity is controlled such that the same copy density is attained for the intermediate density level originals around the level No. 6 as shown by a broken line in FIG. 3(C) and lighter copies are formed for the higher density original while darker copies are formed for the lower density original.

However, in the case of FIG. 3(C), a perfectly black copy is not formed for the black original and a perfectly white copy is not formed for the white original. Accordingly, it is advisable that the light quantity is controlled such that the copy densities in the high density areas and the low density area are brought closer to the original density as shown in FIG. 3(D).

Because it is inconvenient if the copy density abruptly changes at a certain point, it is ideal to adopt an original density versus copy density curve as shown in FIG. 3(D). It is further corrected in accordance with a sensitivity of the photo-sensitive drum 10 used as shown in FIG. 3(F).

In order to attain the copy densities shown in FIGS. 3(A)–3(F), the light quantities are controlled as shown in FIGS. 4(A)–4(F). In the present invention, the original density versus light quantity curves are non-linear as shown in FIGS. 4(A)–4(F), and the light quantity is larger for the darker original, and it is smaller for the lighter original, so that those copy densities are substantially the same as for the intermediate density original.

The non-linear original density versus light quantity characteristic curve described above is stored in the ROM5 and the CPU4 looks up the ROM5 to control the light quantity. Processing steps therefore are shown in a flow chart of FIG. 5. In a step S1 of FIG. 5, the integrated value of the output of the original density detection means such as the light detection means 1*a* or the surface potentiometer 1*b* is loaded to the CPU4 from the input/output port 3 through the A/D converter 2. In a step S2, the CPU4 compares the input density data with the address of the density versus light quantity curve stored in the ROM5 in the form of digital data to read out the light quantity data. That is, the CPU4 addresses the ROM5 by the density data to read out the light quantity data. In a step S3, the light quantity data is loaded in the CPU4. In a step S4, the light quantity data is sent to the D/A converter 6 through the input/output port 3 and the light amount of the light source 12, that is, the voltage applied to the lamp 12 is controlled in accordance with the analog light quantity data. Thus, the developing bias voltage of the developing means 15 may be controlled.

Figure 5:
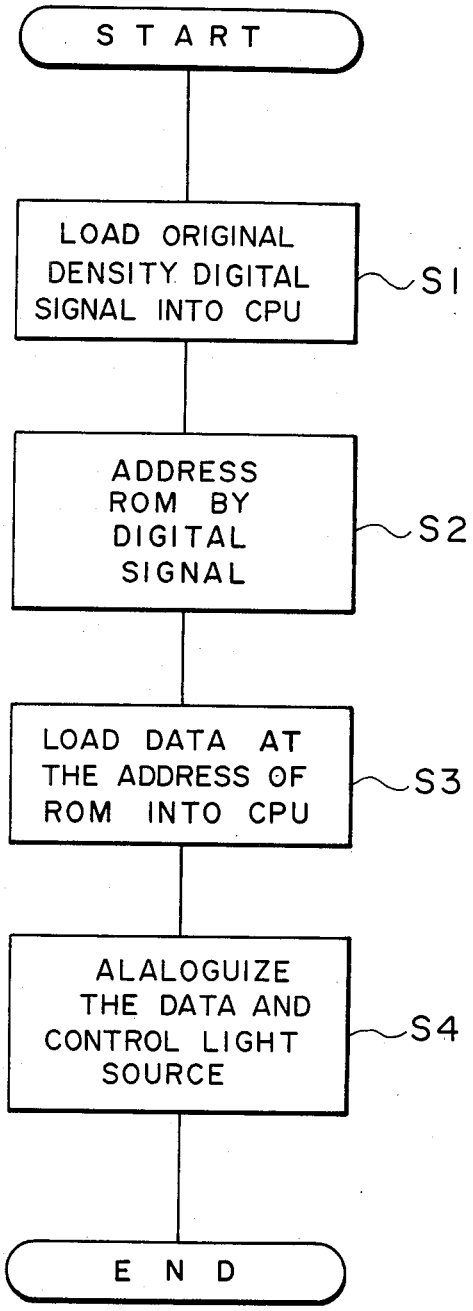
FIG. 5 is a flow chart of processing stops of the circuit of FIG. 2.
Figure 7:
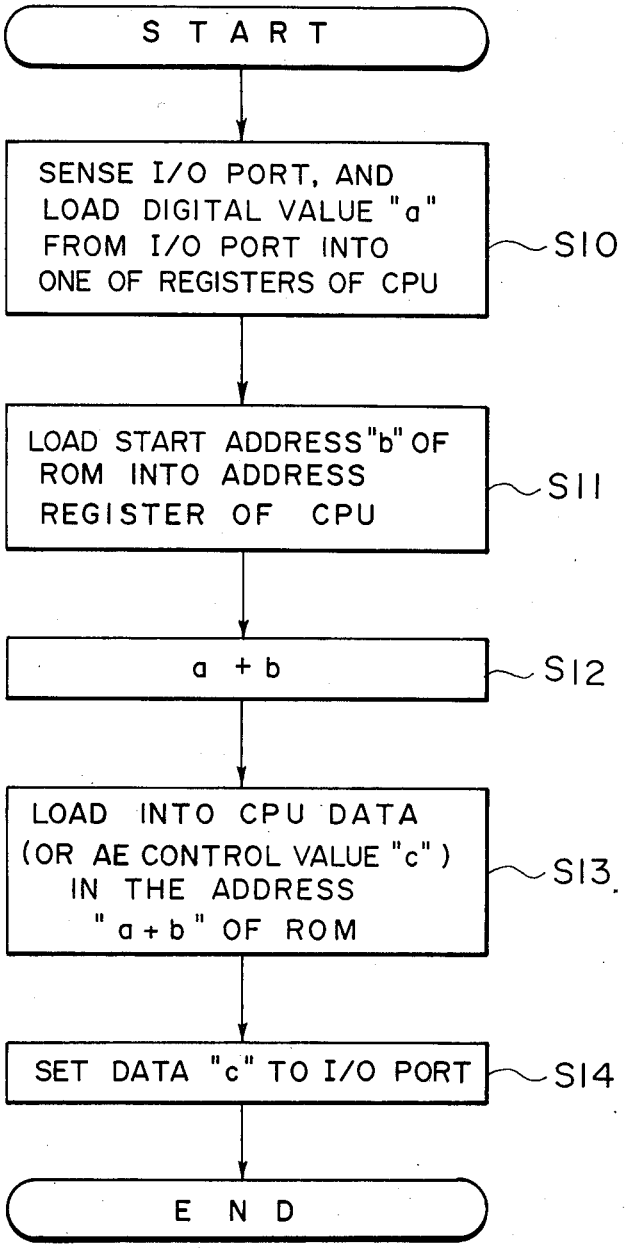
FIG. 7 shows a detailed flow chart of FIG. 5.

FIG. 7 shows a detail of the flow chart of FIG. 5. In a step S10, the microprocessor CPU senses the port of the I10 port 3 and loads the sensed data a (detected integrated value) to one of the registers in the CPU. In a step S11, a start address b of the ROM is loaded to an address register of the CPU. In a step S12, the data a and the start address b are summed. In a step S13, a data c at the sum address is loaded into an accumulator in the CPU. In a step S14, the data c is set to the I10 port and the control data is out-putted.

Another embodiment of the present invention is now explained. In the present embodiment, a photo-sensor is arranged in the light path of an optical system which focuses a light reflected by an original onto a photo-sensitive drum through a lens and an error between a luminance on the photo-sensitive drum and an output of the photo-sensor due to a change of a copying magnification factor is compensated and a developing bias voltage is controlled in accordance with the compensated data to attain a proper copy density.

Figure 8:
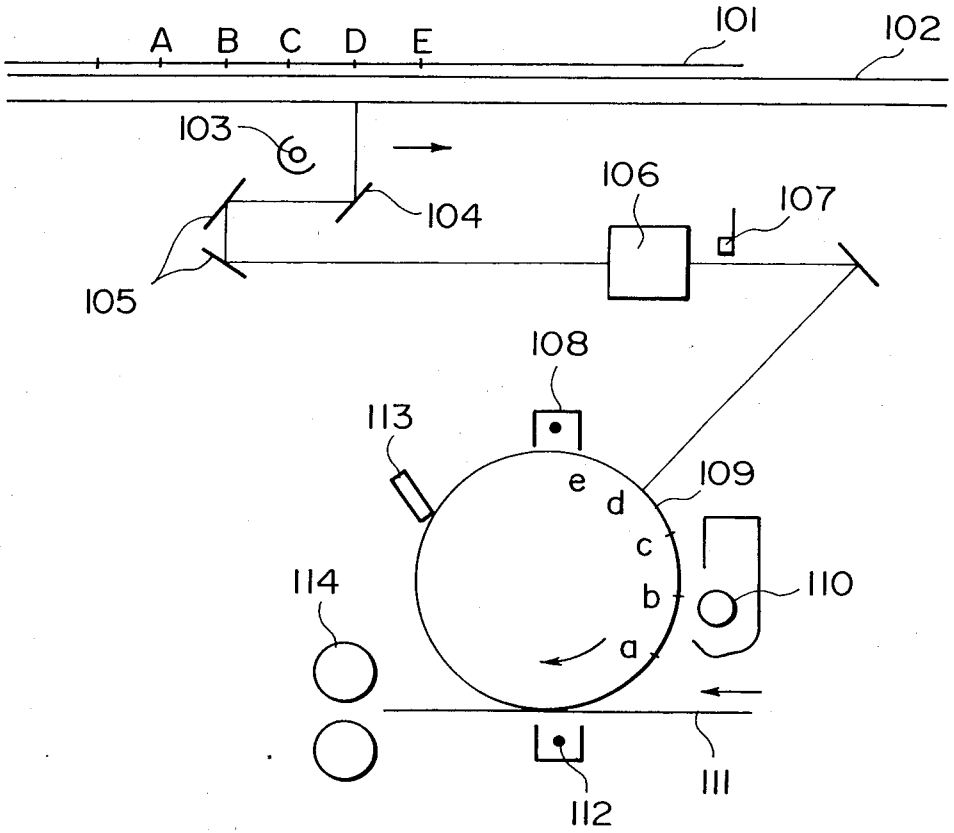
FIG. 8 is a sectional view of another embodiment of a copying machine.

FIG. 8 is similar to FIG. 1. When a copy start button is depressed, a first mirror 104 and second and third mirrors 105 start to scan an original 101 at a velocity ratio of 2 to 1. Light detection means 107 measures a light quantity at a predetermined time interval during the scan to sample data. A, B, C and D and a, b, c and d denote original positions and copy image positions on a drum.

Figure 9:
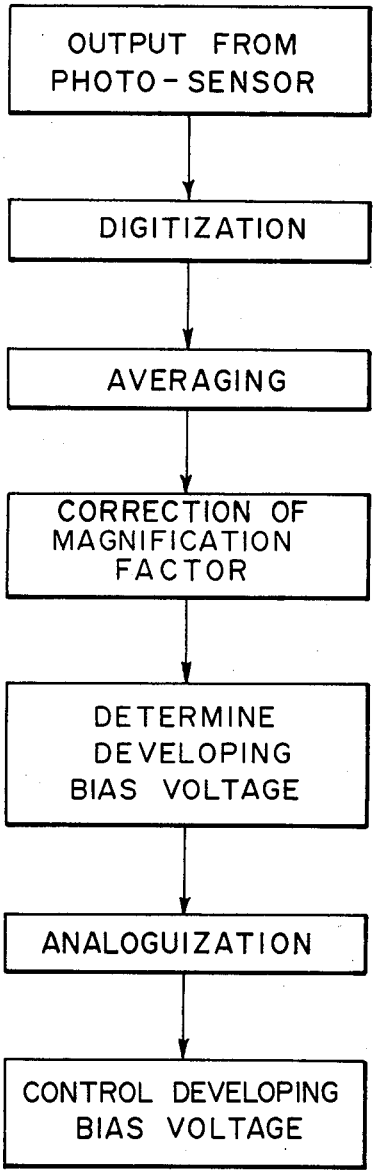
FIG. 9 is a flow chart of the other embodiment.
Figure 10:
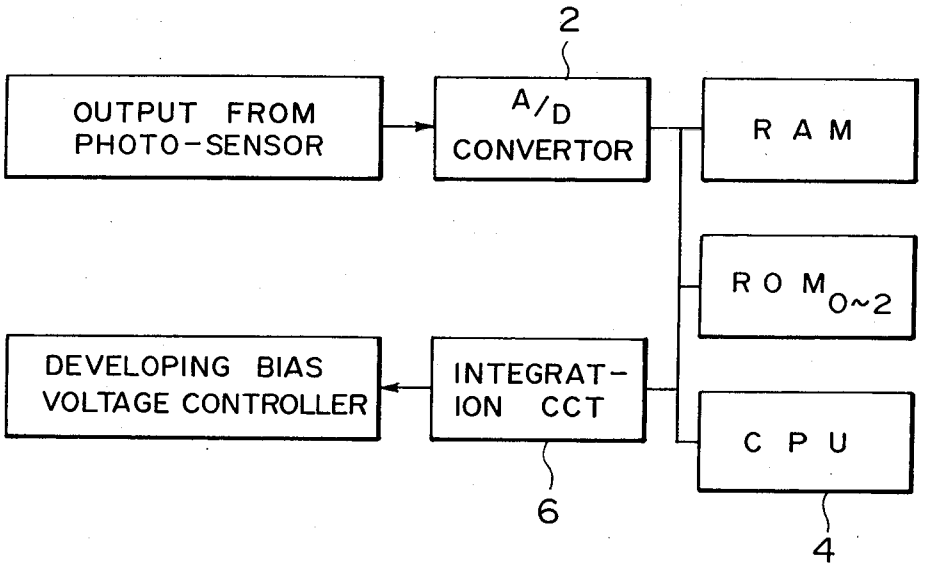
FIGS. 10 and 11 are circuit diagrams of other embodiments.
Figure 11:
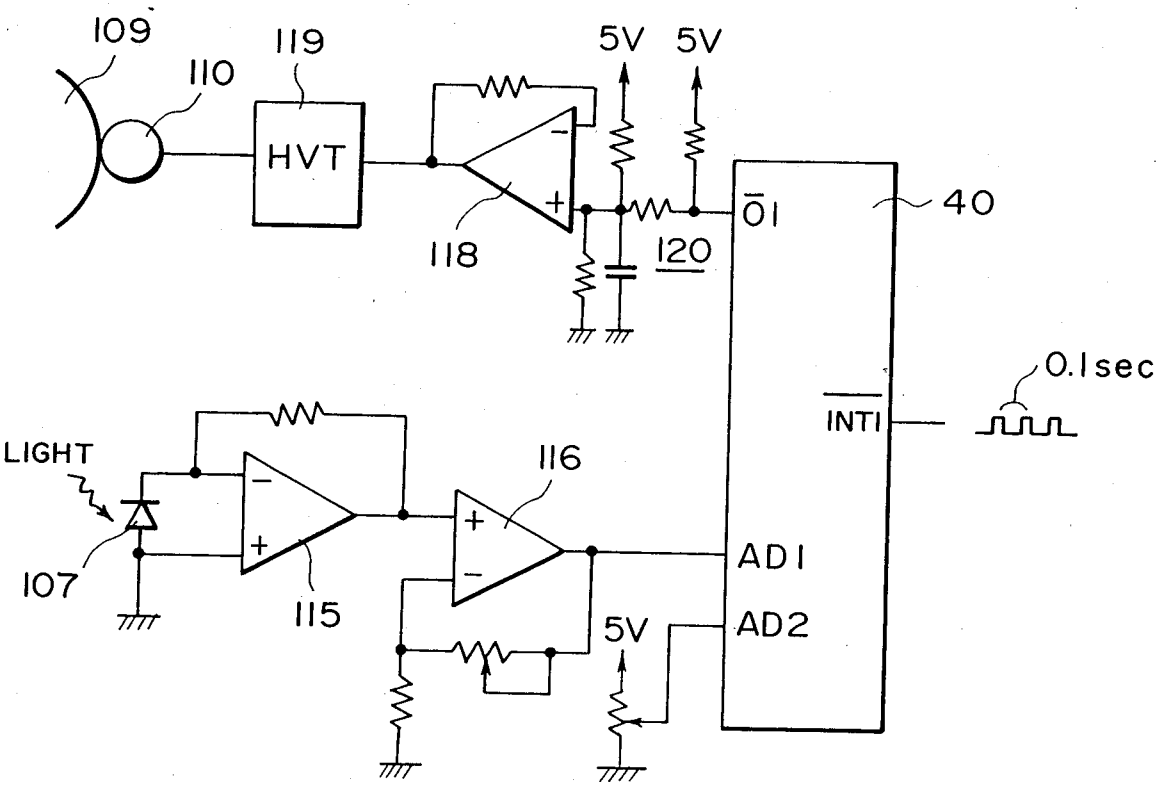
Figures 12, 12A:
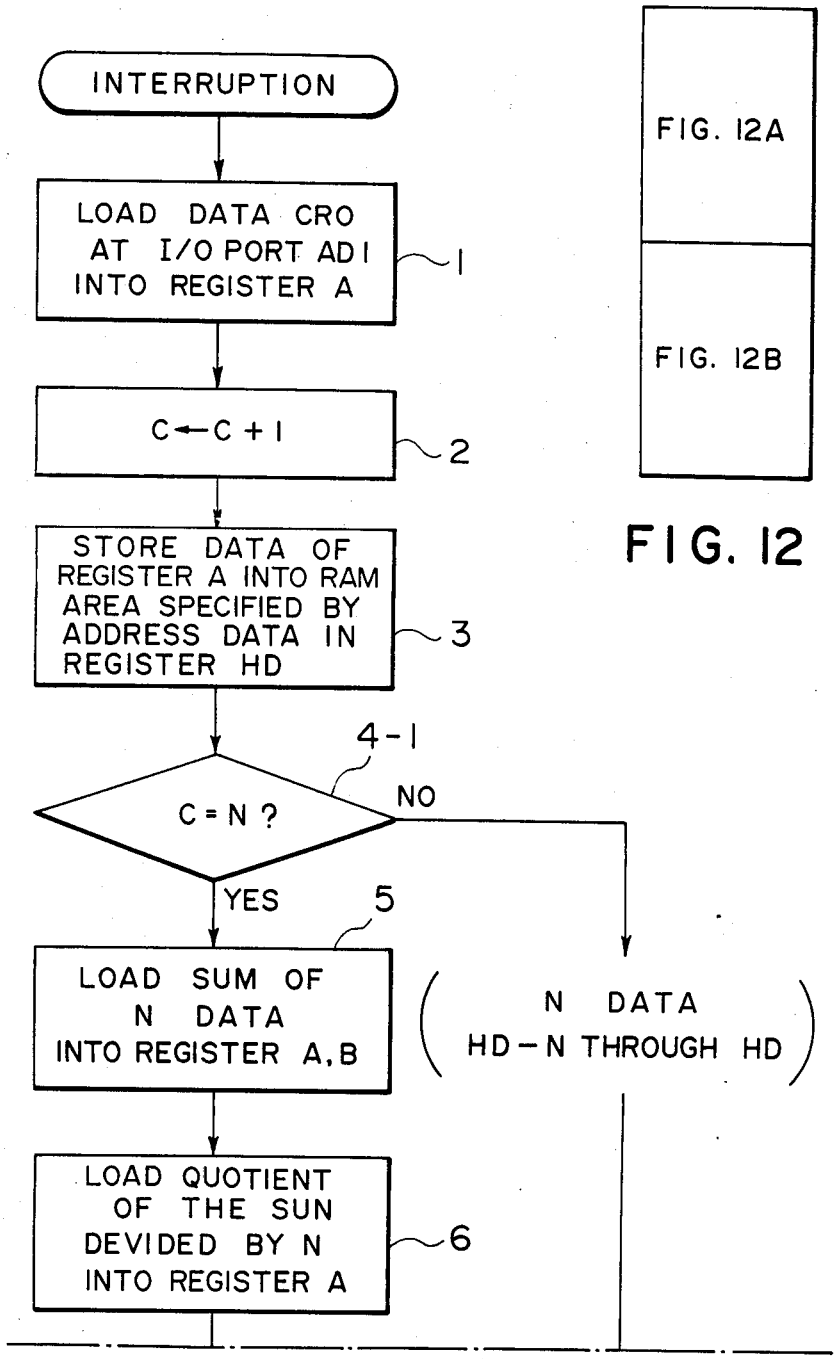
FIG. 12 shows a detailed flow chart of FIG. 9.
Figure 12B:
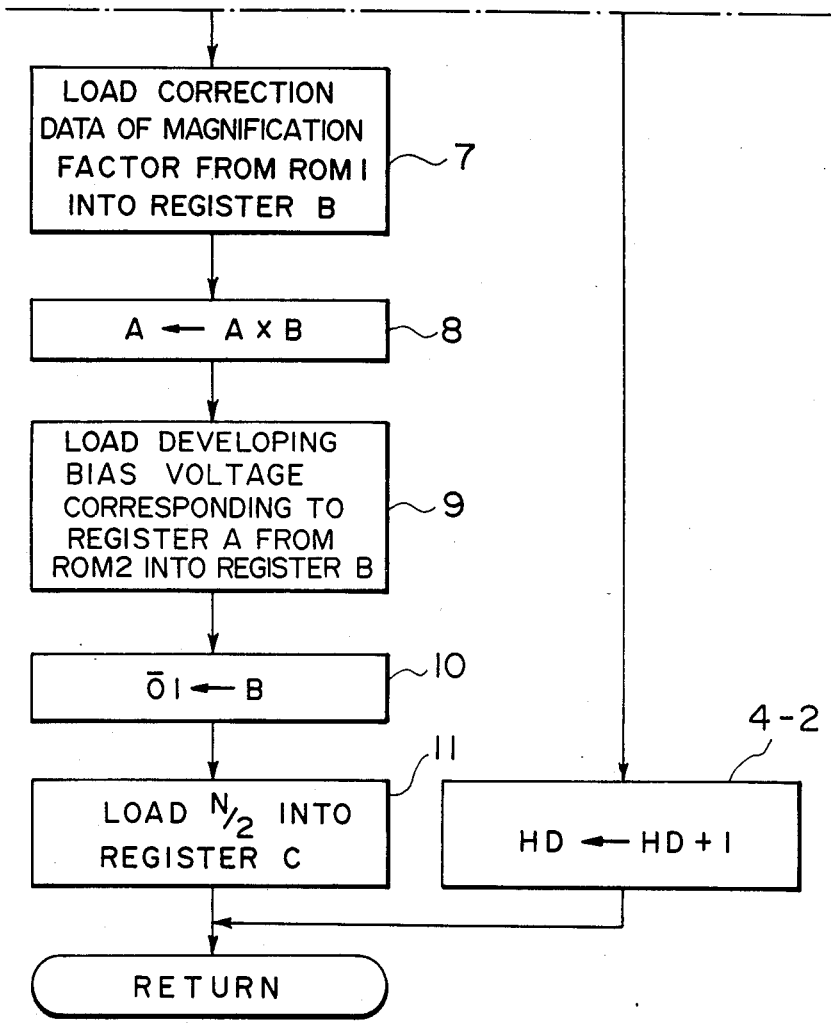

FIG. 9 shows a flow chart for averaging after sampling, correcting a magnification factor and determining a developing bias voltage. FIGS. 10 and 11 show circuits for implementing the steps of FIG. 9, and FIG. 12 shows a flow chart for a program of the above steps stored in a program ROM0 of FIG. 10. A CPU40 shown in FIG. 11 has a A/D converter therein.

FIG. 10 shows an electrical configuration. The sampled data are digitized by the A/D converter and sequentially allocated to address spaces of a RAM and stored therein. The data are averaged before a latent image formed on the photo-sensitive drum by the exposure reaches a developing station and the developing bias voltage is controlled in accordance with the averaged data. In FIG. 8, the developing unit 110 develop an image at a point b while the developing bias voltage is determined by the average of data sampled at an area A–C of the original N times at an interval of 0.1 second. When an image at a point c is next started, N data sampled by the photo-detector 7 in the area B–D of the original are averaged (see FIG. 13) and the developing D.C. bias voltage is controlled in accordance with the averaged data. In this manner, the developing D.C. bias voltage is sequentially controlled.

When a magnification factor is changed, the output is corrected by multiplying a correction factor from a correction ROM to the averaged data. The data are sampled by periodically (e.g. at an interval of 0.1 second) supplying an interrupt signal to INT of FIG. 11 and storing the sampled data at the address spaces of the RAM. Numerals 115 and 116 in FIG. 11 designate similar circuits to the integration circuit fo FIG. 6, numerals 118 and 120 denote an integration circuit and a buffer amplifier of the D/A converter 6, and numeral 119 denotes a transformer for applying the bias voltage to the developing roller 110.

Figure 13:
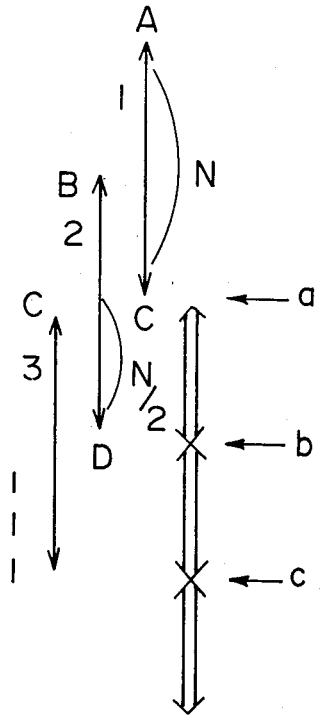
FIG. 13 illustrates control in FIG. 12.

Referring to FIGS. 12 and 13, when an interruption occurs by an input pulse, a data CRO at an input port AD1 is loaded to a register A of the CPU (step 1). A register C which indicates the number of times of sampling is incremented by one (step 2). A register HD which indicates a RAM address is read and the data of the register A is stored at a start address of the RAM (step 3). Since the number of times of sampling is less than N, the address data in the register HD is incremented by one (step 4-2). By a pulse which is produced 0.1 second later, similar sampling and data storing are effected. When the number of times of sampling reaches N, that is, when the sampling for the area A–C is completed, N data in the RAM are summed and the sum is set in the registers A and B (steps 4-1 and 5). The sum data is divided by N and the quotient is loaded in the register A (step 6). The ROM1 contains the correction data for the copy magnification factor. A data for the present magnification factor is read from the ROM1 and loaded to the register B (step 7). The data in the registers A and B are multiplied and the product is loaded to the register A (step 8). The ROM2 is addressed by the data in the register A and the bias data stored at that address is loaded to the register B (step 9). The data in the register B is read through the port 0, to use it as a developing bias data (step 10). A value N/2 is loaded to the register C and the next area (C–D) is sampled (by N/2 times) and the sampled data are stored. The N/2 data are stored in the RAM in the steps 3–5 and the N data, that is, the data for B–D are processed in the steps 5–6 to determine an average. Since the data before and after the data from the photo-sensor are averaged, a high precision is attained. The photo-sensor 107 is arranged at a rear non-image area of a zoom lens 106, which zooms the image in response to a magnification factor selection key. The ROM1 is addressed by the latched data of the selection key so that the correction data is read out. Alternatively, the potentiometer may be arranged at a position immediately rear of the exposing station to control the bias voltage.

In this manner, the density is automatically controlled during the image exposure for the image formation and wasted time is saved.

The present embodiment is also applicable to an apparatus in which the original image is read by the read means such as CCD, converted to the electrical signal which is then converted to the binary video signal, which in turn is used to modulate the laser beam intensity to form the latent image on the drum on which a video signal is transmitted. The original density is detected by the original image read means and determined based on the read original data. One of the controlled image formation conditions may be the digitizing step of the read data. It is attained by changing a threshold level of the digitization in accordance with the detected density.

What I claim is:

1. An image forming apparatus comprising:

processing means for forming an image of an original on a recording member;

detection means for detecting an original image density; and control means for controlling an operation condition of said processing means in accordance with an output from said detecting means, so as to regulate a copy image density;

the control by said control means being such that the relationship between the detected original image density and the copy image density provides a substantially constant copy image density in an intermediate original image density range and provides variation of the copy image density in accordance with the original image density above and below said intermediate original image density range.

2. An image forming apparatus comprising:

processing means for forming an image of an original;

detection means for detecting an original image density; and control means for controlling an operation condition of said processing means in accordance with an output of said detection means, wherein said control means includes a memory for storing a data table corresponding to a relation between data associated with the original image density and data associated with the operation condition of said processing means, and determines the operation condition of said processing means by looking up the data table in accordance with the output from said detection means.

3. An image forming apparatus comprising:

image forming means for forming an image, wherein said image forming means includes exposure means for exposing a medium to the image and processing means for processing the exposed image, there being a delay between exposure of a portion of the image and processing of that portion of the image;

detection means for detecting an image density of the image which is exposed and for outputting a signal representing image density; and control means for processing the density signal to provide a control signal and for controlling an operable condition of the processing means in accordance with the control signal after a lapse of time related to said delay between exposure and processing of respective portions of the image.

4. An image forming apparatus comprising:

processing means for forming an image of an original;

detection means for detecting an image density for each area of the original to produce a detection signal; and control means for controlling an operation condition of said processing means in accordance with an output of said detection means, wherein said control means processes the detection signal from said detection means so as to produce a plurality of control signals, each of which corresponds to a said area of the original, and controls said operation condition of said processing means for each said area of the original in response to said plurality of control signals.

5. An image forming apparatus comprising:

processing means for forming an image of an original, said processing means being capable of forming the image in accordance with a variable magnification;

detection means for detecting an image density of the original;

sampling means for sampling an output of said detection means at a predetermined interval and at a plural number of times, in synchronism with a reference signal; and control means for controlling an operation condition of said processing means in accordance with plural image density data sampled by said sampling means and a slected magnification so as to regulate a copy image density.

6. An image forming apparatus according to any one of claims 1 to 5, wherein said detection means detects light from an original in accordance with the original density.

7. An image forming apparatus according to any one of claims 1 to 5, wherein said detection means detects a potential of a latent image formed by the exposure of an original.

8. An image forming apparatus according to any one of claims 1, 2, 4 and 5, wherein said condition of said processing means controlled by said control means is a quantity of exposure light applied by an original exposure means.

9. An image forming apparatus according to any one of claims 1 to 5 wherein said condition of said processing means controlled by said control means is a quantity of developer applied by a developing means.

10. An image forming apparatus according to claim 1, wherein said control means linearly controls the control output for a change of the detected density in an intermediate density region and substantially constantly controls or controls with a different characteristic than said linear characteristic the control output in high and low density regions.

11. An image forming apparatus according to claim 2, wherein said memory is a read-only memory.

12. An image forming apparatus according to claim 3, wherein said exposed image processing means is developing means.

13. An image forming apparatus according to claim 3, wherein said control means samples a plurality of detected signals in a predetermined period and averages the samples to produce the control signal.

14. An image forming apparatus according to claim 4, wherein said control means produces the control signal based on a data for a current detection area and a data for a previous detection area.

15. An image forming apparatus according to claim 13, wherein said control means divides the original into a plurality of areas and produces the control signal for each area, and said predetermined period corresponds to the image formation time for the area.

16. An image forming apparatus according to claim 3, wherein said control means produces the control signal by adding detected original densities of preceding and/or succeeding parts, related to a specific part of the original being presently detected by said detection means, to a detected original density of said specific part of the original.

* * * * *

UNITED STATES PATENT AND TRADEMARK OFFICE

CERTIFICATE OF CORRECTION

PATENT NO. : 4,702,590

DATED : October 27, 1987

INVENTOR(S) : AKIHIRO USAMI

It is certified that error appears in the above-identified patent and that said Letters Patent is hereby corrected as shown below:

SHEET 5

Figure 5, "ALALOGUIZE" should read --ANALOGIZE--.

SHEET 6

Figure 6, " A/D CONVERTOR " should read -- A/D CONVERTER --.

SHEET 9

Figure 9, "ANALOGUIZATION" should read --ANALOGIZATION--.

SHEET 12

Figure 12A, "SUN" should read --SUM-- and "DEVIDED" should read --DIVIDED--.

COLUMN 1

Line 9, "the" should read --an--.
Line 14, "in" should read --of--.
Lines 18-19, "original. ¶ It" should read --original. It--.
Line 44, "determing" should read --determine--.
Line 65, "other" should read --another--.

UNITED STATES PATENT AND TRADEMARK OFFICE

CERTIFICATE OF CORRECTION

PATENT NO. : 4,702,590

DATED : October 27, 1987

INVENTOR(S) : AKIHIRO USAMI

It is certified that error appears in the above-identified patent and that said Letters Patent is hereby corrected as shown below:

COLUMN 2

Line 1, "other" should read --another--.
Line 5, "other" should read --another--.
Line 9, "other" should read --another--.
Line 13, "other" should read --another--.
Line 30, "stops" should read --steps--.
Line 68, "11b" should read --1b--.

COLUMN 3

Line 43, "256(-$2^8$)" should read --256(=$2^8$)--.

COLUMN 4

Line 20, "FIG. 3(D)." should read --FIG. 3(E).--.
Line 62, "out-putted." should read --outputted.--.

COLUMN 5

Line 19, "a" should read --an--.
Line 27, "develop" should read --develops--.
Line 44, "fo" should read --of--.

UNITED STATES PATENT AND TRADEMARK OFFICE

CERTIFICATE OF CORRECTION

PATENT NO. : 4,702,590

DATED : October 27, 1987

INVENTOR(S) : AKIHIRO USAMI

It is certified that error appears in the above-identified patent and that said Letters Patent is hereby corrected as shown below:

COLUMN 7

Line 49, "slected" should read --selected--.

Signed and Sealed this

Tenth Day of May, 1988

*Attest:*

*Attesting Officer*

DONALD J. QUIGG

*Commissioner of Patents and Trademarks*